US007154223B2

(12) United States Patent
Jeon

(10) Patent No.: US 7,154,223 B2
(45) Date of Patent: Dec. 26, 2006

(54) PLASMA DISPLAY PANEL WITH HEIGHT VARIATIONS OF INTERSECTING FIRST AND SECOND BARRIER RIBS

(75) Inventor: Byung-Soo Jeon, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 116 days.

(21) Appl. No.: 10/972,437

(22) Filed: Oct. 26, 2004

(65) Prior Publication Data

US 2005/0093447 A1 May 5, 2005

(30) Foreign Application Priority Data

Oct. 31, 2003 (KR) ..... 10-2003-0076984

(51) Int. Cl.
*H01J 17/49* (2006.01)

(52) U.S. Cl. ..... 313/582; 313/583; 313/584; 313/585; 313/586

(58) Field of Classification Search ..... 313/582–587; 315/169.1; 345/60, 37, 41, 71
See application file for complete search history.

(56) References Cited

U.S. PATENT DOCUMENTS

| | | | |
|---|---|---|---|
| 5,541,618 A | 7/1996 | Shinoda | |
| 5,661,500 A | 8/1997 | Shinoda et al. | |
| 5,663,741 A | 9/1997 | Kanazawa | |
| 5,674,553 A | 10/1997 | Sinoda et al. | |
| 5,724,054 A | 3/1998 | Shinoda | |
| 5,786,794 A | 7/1998 | Kishi et al. | |
| 5,952,782 A | 9/1999 | Nanto | |
| 6,249,264 B1 * | 6/2001 | Sano et al. | 345/60 |
| RE37,444 E | 11/2001 | Kanazawa | |

(Continued)

FOREIGN PATENT DOCUMENTS

| | | |
|---|---|---|
| CN | 1341269 | 3/2002 |

(Continued)

OTHER PUBLICATIONS

"*Final Draft International Standard*", Project No. 47C/61988-1/Ed.1 ; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing, no month.

*Primary Examiner*—Joseph Williams
*Assistant Examiner*—Hana Asmat Sanei
(74) *Attorney, Agent, or Firm*—Robert E. Bushnell, Esq.

(57) ABSTRACT

A plasma display panel with an improved barrier rib design. The barrier ribs between the substrates are designed to have differing heights to compensate for the difference in the amount of phosphor layer material formed on the tops of the barrier ribs. By designing the barrier ribs so, gaps between the tops of the barrier ribs and the front substrate are reduced or eliminated thus improving image quality. At the same time, the deposition of the phosphor layers is made easier by jet nozzle ejection so that the novel plasma display panel is easy to make. Fluorescent phosphor layers are applied in neighboring discharge cells with the first barrier members interposed there between. A total height of the first barrier members and the phosphor layers applied thereon is substantially the same as the height of the second barrier ribs members. This may protect the plasma display panel from cross-talk phenomenon.

18 Claims, 3 Drawing Sheets

U.S. PATENT DOCUMENTS

| | | | | |
|---|---|---|---|---|
| 6,630,916 | B1 | 10/2003 | Shinoda | |
| 6,707,436 | B1 | 3/2004 | Setoguchi et al. | |
| 6,917,161 | B1 * | 7/2005 | Park et al. | 313/586 |
| 2002/0195936 | A1 * | 12/2002 | Kato et al. | 313/582 |
| 2003/0011307 | A1 * | 1/2003 | Otani et al. | 313/582 |
| 2003/0076038 | A1 * | 4/2003 | Suzuki et al. | 313/582 |
| 2005/0099125 | A1 * | 5/2005 | Tachibana et al. | 313/585 |

FOREIGN PATENT DOCUMENTS

| | | |
|---|---|---|
| JP | 02-148645 | 6/1990 |
| JP | 2845183 | 10/1998 |
| JP | 2917279 | 4/1999 |
| JP | 2001-043804 | 2/2001 |
| JP | 2001-325888 | 11/2001 |

* cited by examiner

PLASMA DISPLAY PANEL WITH HEIGHT VARIATIONS OF INTERSECTING FIRST AND SECOND BARRIER RIBS

CLAIM OF PRIORITY

This application makes reference to, incorporates the same herein, and claims all benefits accruing under 35 U.S.C. §119 from an application for PLASMA DISPLAY PANEL earlier filed in the Korean Industrial Property Office on 31 Oct. 2003 and there duly assigned Serial No. 10-2003-0076984.

BACKGROUND OF THE INVENTION

1. Field of the Invention

The present invention relates to a plasma display panel (PDP), and more particularly, to a structure of barrier ribs that is suitable for applying phosphor along resulting in reduced cross-talk.

2. Description of the Related Art

Generally, a plasma display panel (referred to hereinafter simply as the "PDP") is a display device that displays images based on plasma discharge. When voltages are applied to electrodes formed on substrates of the PDP, a plasma discharge occurs between the electrodes thus generating ultraviolet rays. The ultraviolet rays excite phosphor layers formed in a predetermined pattern, thus displaying the desired visible images.

When manufacturing such a PDP, first, a plurality of barrier ribs are formed, and phosphor layers are then formed thereon. Presently, photolithography, screen-printing or like are used as a method for forming phosphor layers.

Since the structure for the closed barrier ribs is complex, the photolithography, screen printing or the like are not suitable to form the phosphor layers between the closed barrier ribs with a given quality. Also, when using these methods for forming the phosphor layers, if the phosphor layers are formed along the direction of the first barrier rib members, a gap is formed between the tops of the second barrier rib members and a protective layer due to the accumulation of a height of a phosphor layer on the top of the first barrier rib members. In other words, when phosphor is deposited in the cells and on the first barrier rib members but not on the second barrier rib members, and the height of the first and the second barrier rib members are equal, a gap is formed above the tops of the second barrier rib members when the second substrate is combined to the first substrate. Therefore, what is needed is a design for a PDP that minimizes this gap thus preventing deterioration of the discharge characteristics by, for example, preventing cross-talk between neighboring discharge cells.

SUMMARY OF THE INVENTION

It is therefore an object of the present invention to provide an improved design for a plasma display panel.

It is further an object to provide a design for a PDP that prevents the formation of gaps above the tops of barrier rib members.

It is further an object to provide a design for a plasma display panel that is easy to make and improves image quality by reducing cross talk between neighboring cells.

It is further an object to provide a plasma display panel with an improved design for the barrier ribs.

These and other objects can be achieved by a plasma display panel with barrier ribs of varying heights, so that when phosphor layers are applied to the barrier ribs, the resultant display has less gap and hence less cross-talk or similar interference between neighboring discharge cells than if all the barrier ribs were formed to have the same height.

A plasma display panel according to one embodiment of the present invention includes a first substrate and a second substrate opposing each other, first electrodes formed on the first substrate, second electrodes formed on the second substrate and in a direction intersecting the first electrodes, barrier ribs arranged in the space between the first substrate and the second substrate to define a plurality of discharge cells, and phosphor layers formed in each of the discharge cells. The barrier ribs may include first barrier ribs formed parallel to the first electrodes and second barrier ribs formed parallel to the second electrodes while intersecting the first barrier ribs. The phosphor layers of the same color are applied in the discharge cells neighboring each other with the first barrier members interposed therebetween. At this time, the combined height of the first barrier members and the phosphor layers applied thereon is substantially the same as the height of the second barrier rib members. Other design conditions include the height of the phosphor layers may be formed to have a thickness on top of the first barrier rib members in the range of 3 μm through 7 μm. The phosphor layers may be formed by applying phosphor paste using a jet nozzle.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
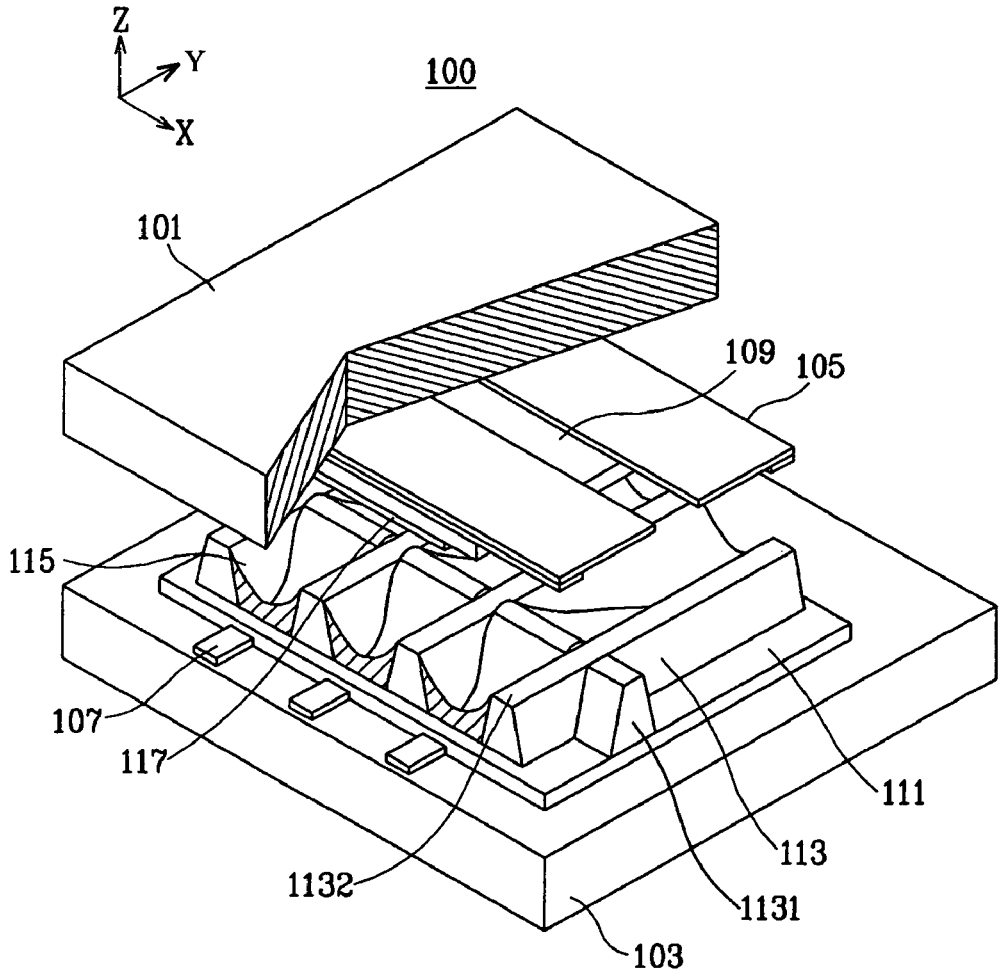
FIG. 1 is an exploded perspective view of a PDP.

Turning now to the figures, FIG. 1 is an exploded perspective view of discharge cells used in an AC PDP 100. With reference to FIG. 1, an AC PDP 100 includes a rear substrate 103, address electrodes 107 formed on the rear substrate 103, a dielectric layer 111 formed on a top surface of the rear substrate 103 covering the address electrodes 107, a plurality of barrier ribs 113 formed over the dielectric layer 111 to maintain a constant discharge distance between barrier ribs 113 and dielectric layer 111 and to protect the AC PDP 100 from the cross-talk among the discharge cells and phosphor layers 115 formed between each neighboring barrier ribs 113.

As illustrated in FIG. 1, display electrodes 105 are formed on front substrate 101 in pairs spaced with each display electrode 105 corresponding to one discharge cell and intersecting the address electrodes 107 formed on the rear substrate 103. A dielectric layer 109 and a protective layer 117 are sequentially formed and covering the display electrodes 107 on a bottom side of front substrate 101.

In more detail, in the PDP 100 illustrated in FIG. 1, the barrier ribs 113 are made up of a plurality of first barrier rib members 1131 intersecting the address electrodes 107 and a plurality of second barrier rib members 1132 intersecting the first barrier rib members 1131. Such a closed structure of the barrier ribs 113 enables discharge characteristics to be enhance when compared to a striped structure where a plurality of barrier ribs are arranged only along one direction and usually in parallel to the address electrodes.

In the formation of the PDP 100 of FIG. 1, when a nozzle jet is used to deposit the phosphor layers 115 on the dielectric layer 111 and the barrier ribs 113, phosphor layers 115 may accumulate on the tops of first barrier rib members 1131 but not on the second barrier rib members 1132. This can be problematical when the first and the second barrier rib members 1131 and 1132 respectively are formed to have the same height. When combined to the front substrate 101, the phosphor layer 115 on top of the first barrier rib members 1131 causes a gap to exist between the tops of the second barrier rib members 1132 and the protective layer on the bottom of the front substrate 101. This gap causes cross talk between neighboring discharge cells.

Figure 2:
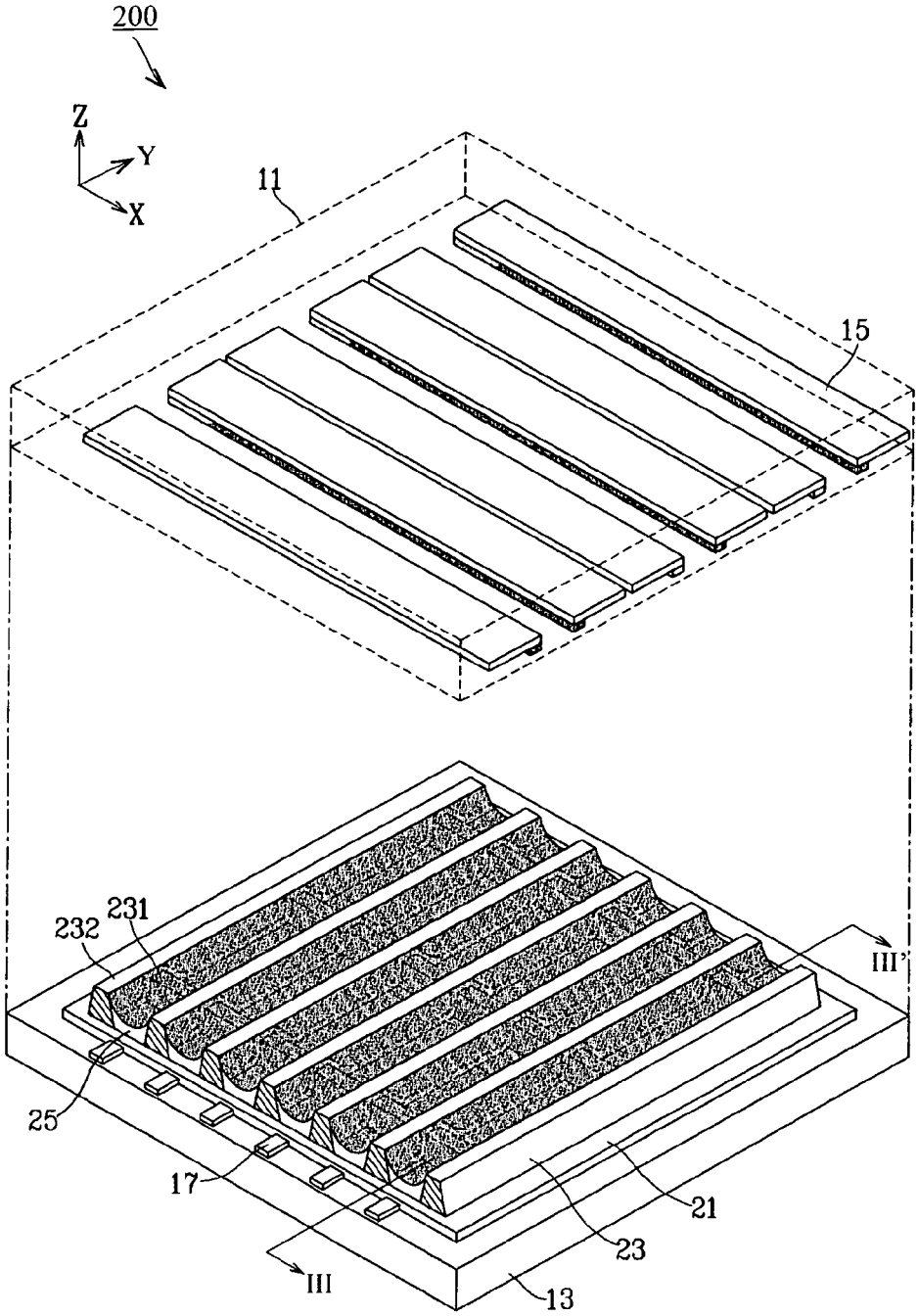
FIG. 2 is an exploded perspective view of a plasma display panel according to an exemplary embodiment of the present invention.

Turning now to FIG. 2, FIG. 2 is an exploded perspective view illustrating schematically a plasma display panel 200 according to an embodiment of the present invention. As illustrated in FIG. 2, PDP 200 has a front substrate 11 and rear substrate 13 facing the front substrate 11. In FIG. 2, the front substrate 11 and the rear substrate 13 are illustrated as being spread apart in order to better emphasize the barrier ribs and the discharge cells between these two substrates.

In FIG. 2, the front substrate 11 (or first substrate) is illustrated using broken lines, and first electrodes 15 on front substrate 11 are illustrated with solid lines. Although not illustrated, a dielectric layer and a protective layer may be formed sequentially on the lower side of front substrate 11 covering the first electrodes 15. Also as illustrated in FIG. 2, a rear substrate 13 (or second substrate) has a plurality of second electrodes 17 arranged in parallel thereon. Over the second electrodes 17 is formed a dielectric layer 21 for protecting the second electrodes 17. Then, the barrier ribs 23 are formed on the dielectric layer 21 and then phosphor layers 25 are applied to the resultant structure.

In the PDP 200 of FIG. 2 according to the present invention, the barrier ribs 23 are formed in a closed structure. Barrier ribs 23 are made out of a first barrier rib members 231 (illustrated in a broken line) intersecting the second electrodes 17 and second barrier rib members 232 intersecting the first barrier rib members 231 essentially orthogonally. Here, the first barrier rib members 231 may have a lower height than the second barrier rib members 232. The discharge cells are bounded by pairs of the first and second barrier rib members 231, 232. The shape of the second barrier rib members 232 are not limited to the shape illustrated in FIG. 2, various other shapes may be used. Meanwhile, the second barrier rib members 232 may be formed by means of etching or sandblasting.

The barrier ribs may be made by a process called "firing" which is a high temperature manufacturing process where various materials mixed with glass frit are heated to make the barrier ribs. After firing the barrier ribs formed as above, a phosphor paste is applied between the neighboring barrier ribs to form phosphor layers 25. In this embodiment, the phosphor layers of same color can be applied to neighboring discharge cells separated by first barrier members 231.

In the PDP 200 according to the present invention, driving voltages are applied between the first and second electrodes 15, 17 such that an address discharge between these two electrodes occurs, thus forming wall charges in the dielectric layers (not illustrated). When a sustain pulse signal is alternately applied to a pair of the first electrodes 15, sustain discharge occurs between them in the discharge cell selected by the address discharge. As a result, discharge gas charged in the discharge space generates ultraviolet rays, these ultraviolet rays excite phosphors thus displaying the visible image.

Figure 3:
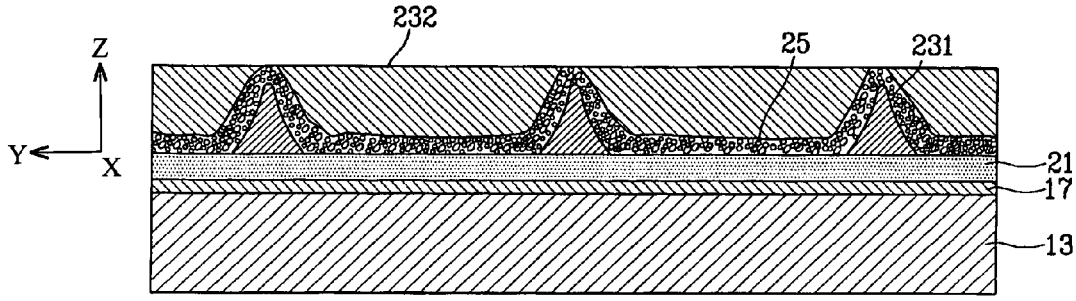
FIG. 3 is a cross-sectional view of the PDP of FIG. 2 taken along line III–III'.

In this embodiment, since the phosphor paste is deposited on top of the first barrier rib members 231 illustrated as a broken line in FIG. 2, the height of the first barrier rib members 231 is preferably designed so that the combined height of the first barrier rib members 231 and phosphor layers 25 is approximately equal to the height of the second barrier rib members 232. This is so there is no gap left between the tops of the second barrier rib members 232 and the protective layer on the bottom of front substrate 11 when the front substrate 11 is combined with the rear substrate 13. FIG. 3 will illustrate this concept more clearly.

Turning now to FIG. 3, FIG. 3 illustrates a cross-sectional view of PDP 200 of FIG. 2 taken along line III–III' of FIG. 2 and looking in the +x direction. FIG. 3 clearly illustrates a cross section of the barrier ribs 23 used in plasma display panel 200 according to one embodiment of the present invention As illustrated in FIG. 3, an embodiment of the plasma display panel 200 may include barrier ribs 23 having a plurality of the first barrier rib members 231 and a plurality of the second barrier rib members 232 intersecting the plurality of first barrier rib members 231. The first barrier rib members 231 on which phosphor paste is deposited are formed to have a smaller height than that of the second barrier rib members 232. The height difference between the first and second barrier rib members 231, 232 may vary. In some embodiments, the combined height of the first barrier rib member 231 and the height of the phosphor layer 25 deposited on it may be approximately the same height as the second barrier rib members 232.

The firing may allow the phosphor layers 25 to be tightly fitted to the first barrier rib members 231. In addition, use of the firing method also prevents the formation of a gap between the second barrier rib members 232 and the protective layer formed over them. Therefore, in this embodiment, the plasma display panel 200 is protected sufficiently from cross-talk phenomenon between neighboring discharge cells.

In this embodiment, a nozzle jet apparatus with a plurality of nozzles is provided to discharge the phosphor paste between the first barrier rib members 231 to form the phosphor layers 25 on them. The phosphor paste may be applied through the jet nozzle of the nozzle injecting apparatus, through a firing process or similar techniques known in the art. The amount of the phosphor paste applied through the jet nozzle injecting apparatus is determined considering deformation on firing or the like so that the total, combined height of the first barrier rib members 231 and phosphor layers 25 deposited on them are approximately the same height as the second barrier rib members 232. By designing the barrier ribs and the phosphor layer application in this way, a tight fit can be formed between the protective layer (not illustrated) on the bottom of the front substrate 11 and the tops of the second barrier rib members 232. Such a tight fit prevents cross talk between neighboring discharge cells.

Generally, in the present invention, the first and second barrier rib members 231, 232 are designed to have different heights. Accordingly, the phosphor layers 25 may be formed on the first barrier rib members 231 at a thickness of from about 3 μm to about 7 μm such that there is a difference in height between the first and second barrier rib members 231 and 232 respectively. The height difference is determined by the amount of phosphor paste applied. If the height difference is below 3 μm, cross-talk occurs in the same manner as in plasma display panel 100 of FIG. 1. If the height difference is greater than about 7 μm, it is difficult for the phosphor paste to be applied on the first barrier rib members because too much phosphor paste is applied on the first barrier rib members 231

In the PDP 200 described above, the total height of the first barrier rib members 231 and phosphor layers 25 deposited on the first barrier rib members may be approximately the same as the height of the second barrier rib members 232. Deposits on neighboring discharge cells may include the same color phosphor layers to minimize the amount of phosphor paste left on the barrier ribs, to reduce the usage of the phosphor paste, and also to protect the PDP from cross-talk phenomenon.

The phosphor layers formed on the first barrier rib members 231 and can have a height of 3 μm through 7 μm thus reducing the cross-talk and making the process for forming the phosphor layers easy. Also, production efficiencies may be increased when the nozzle injecting method is used to manufacture large quantities of plasma display panels.

Although embodiments of the present invention have been described in detail hereinabove in connection with certain embodiments, it should be understood that the invention is not limited to the disclosed embodiments, but, on the contrary is intended to cover various modifications and/or equivalent arrangements included within the spirit and scope of the present invention, as defined in the appended claims.

What is claimed is:

1. A plasma display panel, comprising:

a first substrate;

a plurality of first electrodes arranged on the first substrate;

a second substrate, the second substrate being arranged opposite the first substrate;

a plurality of second electrodes arranged on the second substrate along the direction intersecting the first electrodes;

barrier ribs arranged in a space between the first substrate and the second substrate to define a plurality of discharge cells; and phosphor layers arranged in the plurality of discharge cells, wherein the phosphor layers are applied in the discharge cells neighboring each other with the first barrier members interposed therebetween, wherein the barrier ribs comprise first barrier rib members arranged in parallel to the first electrodes and second barrier rib members arranged in parallel to the second electrodes, wherein the second barrier rib members intersect the first barrier rib members, and wherein a combined height of the first barrier rib members together with the phosphor layers applied thereon is substantially equal to a height of the second barrier rib members.

2. The plasma display panel of claim 1, wherein a height of the phosphor layers applied on the first barrier rib members is in a range from 3 μm to 7 μm.

3. The plasma display panel of claim 1, wherein the phosphor layers are formed by applying phosphor paste with jet nozzle.

4. The plasma display panel of claim 1, tops of the first barrier rib members having phosphor layers thereon and tops of the second barrier rib members being absent phosphor layers.

5. The plasma display panel of claim 1, further comprising a dielectric layer and a protective layer formed over the first electrodes on the first substrate, the protective layer forming direct contact with the tops of the second barrier rib member and forming direct contact with phosphor layers on top of the first barrier rib members.

6. The plasma display panel of claim 5, the protective layer being essentially flat.

7. The plasma display panel of claim 1, the first barrier rib members being essentially orthogonal to the second barrier rib members.

8. A plasma display panel, comprising:

a first substrate;

a plurality of first electrodes arranged on the first substrate;

a second substrate, the second substrate facing the first substrate;

a plurality of second electrodes arranged on the second substrate and crossing the first electrodes;

a first dielectric layer covering the first electrodes on the first substrate;

a second dielectric layer covering the second electrodes on the second substrate;

a protective layer covering the first dielectric layer;

barrier ribs dividing a space between the first and the second substrates into a plurality of discharge cells, the barrier ribs comprising first barrier rib members formed essentially parallel to the first electrodes and second barrier rib members formed essentially parallel to the second electrodes and crossing the first barrier rib members; and phosphor layers arranged on the second dielectric layer and on sidewalls of the barrier ribs and on tops of the first barrier rib members but not on top of the second barrier rib members, wherein the first barrier rib members are designed to have a different height than the second barrier rib members, the barrier ribs being designed so that the difference in height between the second barrier rib members and the first barrier rib members is essentially equal to a thickness of the phosphor layers.

9. The plasma display panel of claim 8, the barrier ribs being designed so that the difference in height between the second barrier rib members and the first barrier rib members is essentially equal to a thickness of the phosphor layers on the top of the first barrier rib members.

10. The plasma display panel of claim 8, the protective layer forming direct contact with the tops of the second barrier rib members but not forming direct contact with the first barrier rib members.

11. The plasma display panel of claim 8, the first barrier rib members and the second barrier rib members forming a plurality of closed quadrilaterals that define said plurality of discharge cells.

12. The plasma display panel of claim 8, the phosphor layers being formed via jet nozzle application.

13. The plasma display panel of claim 8, the phosphor layers on top of the first barrier rib members having a thickness between 3 and 7 microns.

14. A plasma display panel, comprising:

a first substrate;

a plurality of first electrodes arranged on the first substrate;

a second substrate, the second substrate being arranged opposite the first substrate;

a plurality of second electrodes arranged on the second substrate along the direction intersecting the first electrodes;

barrier ribs arranged in a space between the first substrate and the second substrate to define a plurality of discharge cells; and phosphor layers arranged in the plurality of discharge cells, the barrier ribs comprise first barrier rib members arranged in parallel to the first electrodes and second barrier rib members arranged in parallel to the second electrodes, the phosphor layers being arranged on top of the first barrier rib members but not on top of the second barrier rib members, the second barrier rib members being taller than the first barrier rib members by a thickness of the phosphor layers.

15. The plasma display panel of claim 14, a thickness of the phosphor layers on top of the first barrier rib members being between 3 and 7 microns.

16. The plasma display panel of claim 15, the second barrier rib members being taller than the first barrier rib members by 3 to 7 microns.

17. The plasma display panel of claim 15, the second barrier rib members being taller than the first barrier rib members by a thickness of the phosphor layers on top of the first barrier rib members.

18. The plasma display panel of claim 17, the phosphor layers being formed by nozzle jet.

* * * * *